US007323964B1

(12) United States Patent
Shyu et al.

(10) Patent No.: US 7,323,964 B1
(45) Date of Patent: Jan. 29, 2008

(54) NON-CONTACT POWER SYSTEM WITH LOAD AND GAP DETECTION

(75) Inventors: Kuo-Kai Shyu, Jhongli (TW); Ko-Wen Jwo, Taipei (TW); Chih-Hung Lo, Jhongli (TW)

(73) Assignee: National Central University, Taoyuan County (TW)

( * ) Notice: Subject to any disclaimer, the term of this patent is extended or adjusted under 35 U.S.C. 154(b) by 0 days.

(21) Appl. No.: 11/607,048

(22) Filed: Dec. 1, 2006

(30) Foreign Application Priority Data

Nov. 23, 2006 (TW) ..... 95143311 A

(51) Int. Cl.
*H01F 21/06* (2006.01)

(52) U.S. Cl. ..... 336/131; 336/132

(58) Field of Classification Search ..... 336/130–135
See application file for complete search history.

(56) References Cited

U.S. PATENT DOCUMENTS 5,157,319 A * 10/1992 Klontz et al. ..... 320/108
6,489,874 B2 * 12/2002 Katsura et al. ..... 336/130

* cited by examiner

*Primary Examiner*—Anh Mai
(74) *Attorney, Agent, or Firm*—Troxell Law Office, PLLC

(57) ABSTRACT

A non-contact power system transfers power and signals simultaneously. The signals control the non-contact power system. And an operational frequency is operated on a resonant frequency so that there is no voltage alternating on power switch and power loss is reduced.

20 Claims, 2 Drawing Sheets

NON-CONTACT POWER SYSTEM WITH LOAD AND GAP DETECTION

FIELD OF THE INVENTION

Figure 1:
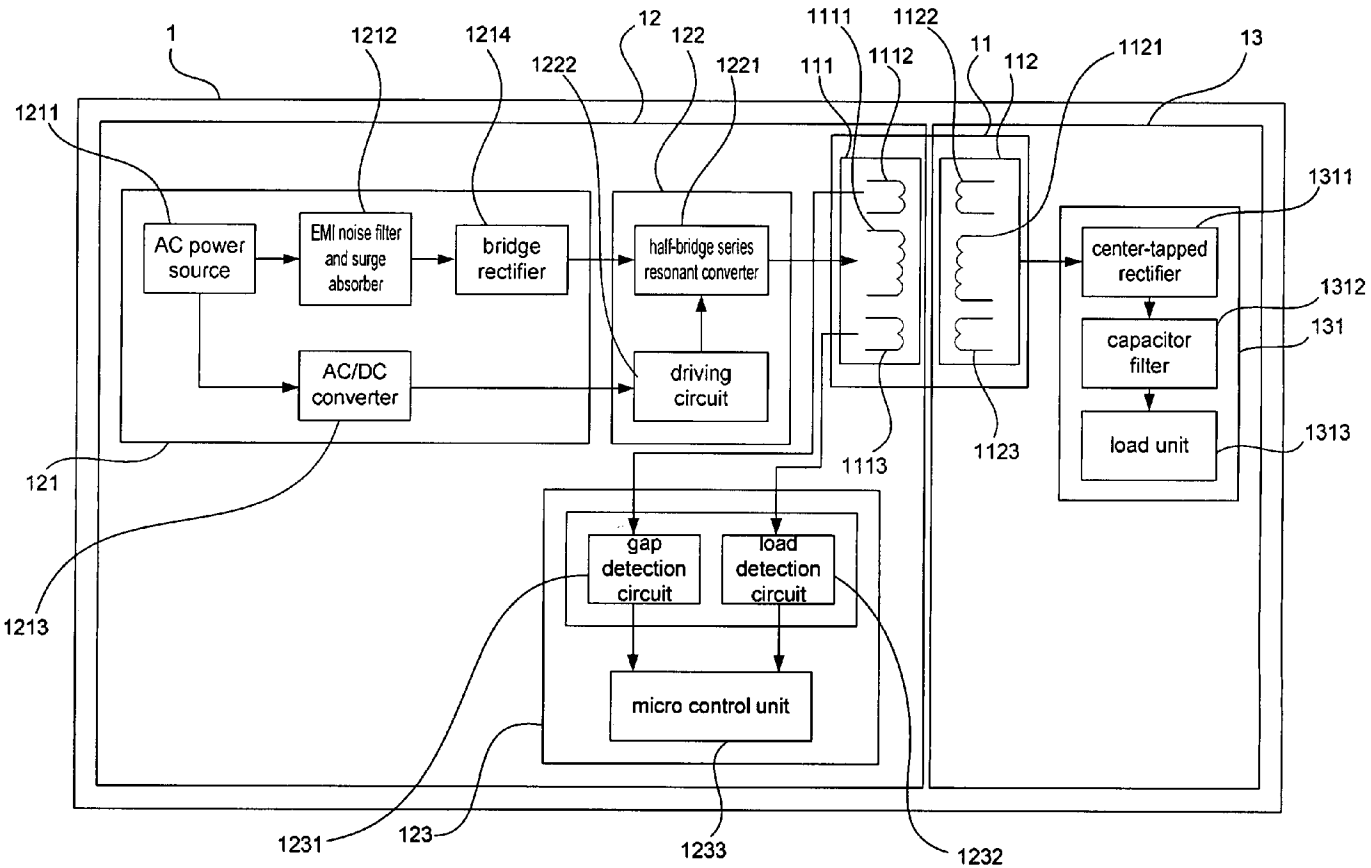

The present invention relates to a non-contact power system; more particularly, relates to obtaining changes in gap size and output load through electromagnetic coupling to automatically adjust frequency for stable output voltage.

DESCRIPTION OF THE RELATED ARTS

A contact power system transfers power by contacting a plug and a socket, where a spark may happen on contacting the plug and the socket. In addition, the contact point may be worn out, oxidized or covered by dust and is not well contacted so that a transfer rate may be reduced and the lifetime of the system is shortened, not to mention the inconvenience of plugging the plug into the socket.

A non-contact power system has a great potential to be applied to pits, devices for oil mining, medical machines and dust-free room. The non-contact power system is also applied to an electric toothbrush, an electric shaver, a wireless mouse, a mobile telephone, etc. And, the technique concerning applying the non-contact power system to electric vehicles is developed for years, such as non-contact power chargers for electric vehicles developed in USA and Japan.

In these years, a technique of wireless power charger for the electric vehicle is mature. And it is still under development concerning power converters and conversion efficiency. A design of an electromagnetic coupler inside the wireless power system provides a bi-directional transference of power and signals; and the wireless power system is monitored and controlled through data comparison.

Additionally, assuring data accuracy in a transference and avoiding signals from interferences are essential in designing an electromagnetic coupler. However, to stabilize the system and control its performance, changes on load and gap in the system need to be acquired. Yet the separation in the structure makes current statuses of the load and the gap hard to be precisely known.

As a result, concerning a contact power system, a spark may be produced on contacting a plug and a socket; a contact point may be worn out, oxidized or covered by dust and is not well contacted and so a transfer rate may be reduced and the lifetime of the system is shortened; and plugging a plug into a socket may be inconvenient in some situations. In the other hand, concerning a no n-contact power system, current statuses of load and gap is hard to be precisely known. Hence, the prior arts do not fulfill users' requests on actual use.

SUMMARY OF THE INVENTION

The main purpose of the present invention is to obtain changes in gap size and output load, to transfer power and signals simultaneously and to automatically adjust frequency to obtain a stable output voltage To achieve the above purpose, the present invention is a non-contact power system with load and gap detection, comprising a non-contact transformer, a primary device and a secondary device, where the non-contact transformer comprises a first core and a second core; the first core and the second core each comprises one energy coil and two signal coil; the primary device is connected with the first core and comprises an input stage module, a power stage module and a feed-back control module; the in put stage module comprises an alternating current (AC) power source, an electromagnetic interference (EMI) noise filter and surge absorber, an AC/DC (direct current) converter and a bridge rectifier; the power stage module comprises a half-bridge series resonant converter and a driving circuit; the feed-back control module comprises a gap detection circuit, a load detection circuit and a micro control unit; the secondary device is connected with the second core and comprises an output stage module; and the output stage module comprises a center-tapped rectifier, a capacitor filter and a load unit. Accordingly, a novel non-contact power system with load and gap detection is obtained.

BRIEF DESCRIPTIONS OF THE DRAWINGS

Figure 2:
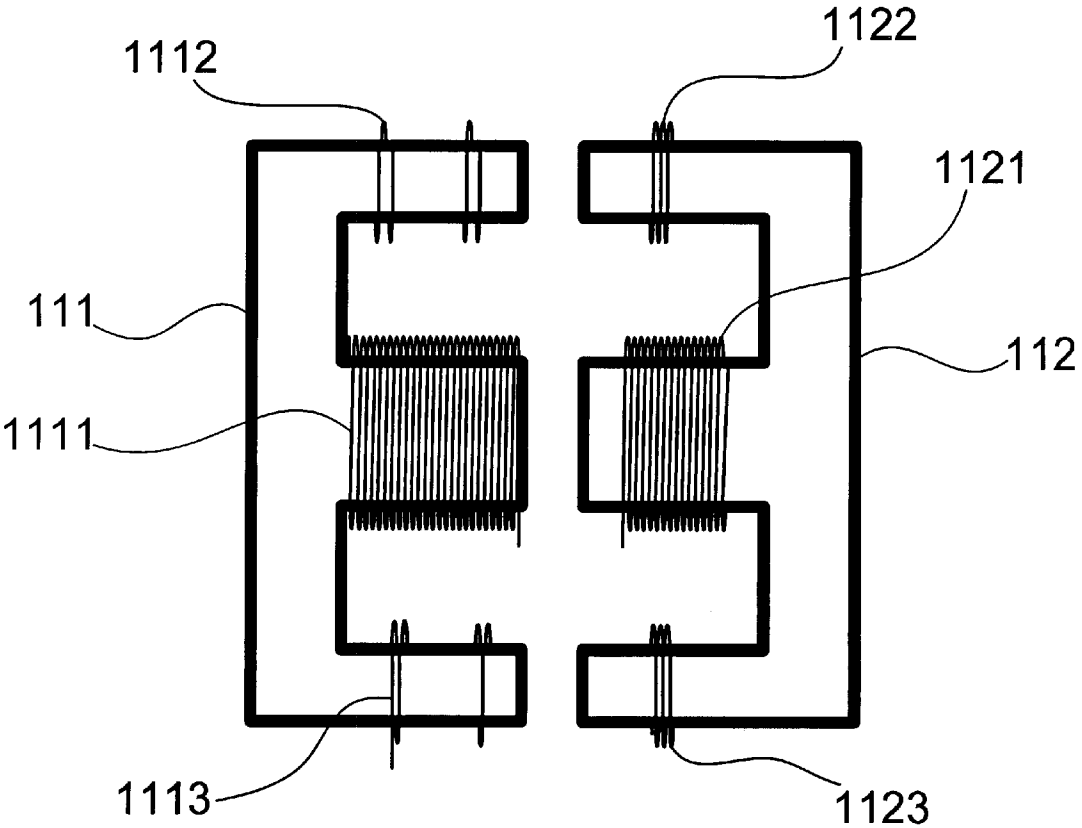

The present invention will be better understood from the following detailed description of the preferred embodiment according to the present invention, taken in conjunction with the accompanying drawing, in which FIG. 1 is the structural view showing the preferred embodiment according to the present invention; and FIG. 2 is the enlarged view showing a core of the preferred embodiment.

DESCRIPTION OF THE PREFERRED EMBODIMENT

The following description of the preferred embodiment is provided to understand the features and the structures of the present invention.

Please refer to FIG. 1 and FIG. 2, which are a structural view showing a preferred embodiment and an enlarged view showing a core of the preferred embodiment according to the present invention. As shown in the figures, the present invention is a non-contact power system 1 with load and gap detection, comprising a non-contact transformer 11, a primary device 12 and a secondary device 13, where the non-contact transformer 11 comprises a first core 111 and a second core 112; the first core 111 comprises a first energy coil 1111, a first signal coil 1112 and a second signal coil 113; the first core 111 is connected with the primary device 12; the second core 112 comprises a second energy coil 121, a third signal coil 1122 and a fourth signal coil 1123; the second core 112 is connected with the secondary device 13; the first energy coil 1111 and the second energy coil 1121 have the same winding direction; and the third energy coil 1122 and the fourth energy coil 1123 have opposite winding directions. When using the present invention, magneto resistance is produced. The first signal coil 1112 is at the upper side of the first core 111 and has the same winding direction as the first energy coil 1111. The second signal coil 1112 is at the lower side of the first core 111 and has a reverse winding direction to the first energy coil 1111 to balance off energy. Or, the second signal coil 1113 has the same winding direction as the first energy coil 1111 to enhance energy. And the first core 111 and the second core 112 each can be further added with one energy coil and two signal coils. An area enclosed by the first energy coil 1111 of the first core 111 and the second energy coil 1121 of the second 0 core 112 is twice larger than an area enclosed by the first and the second signal coils 1112, 1113 of the first core 111 and the third and the fourth signal coils 1114, 1115 of the second core 112. That is, the magneto resistance at the upper side and the lower side of the first core 111 and the second core 112 is only a half to the magneto resistance in the middle. An alternating magnetic flux is produced at the coil of the first core 111 by alternating a power switch. The magnetic flux is uniformly distributed at two opposite sides of the first core 111. Hence the alternating magnetic flux of the first energy coil 1111 has the lowest impact on the first and the second signal coils 1112, 1113 and thus the signal recognition is improved for the signal coil. As a result, by surrounding a core with coils according to the present invention, changes in load and gap of a non-contact power system are acquired.

The primary device 12, comprising an input stage module 121, a power stage module 122 and a feed-back control module 123, provides a power source for the non-contact power system 1, where the input stage module 121 comprises an alternating current (AC) power source 1211, an electro-magnetic interference (EMI) noise filter and surge absorber 1212, an AC/DC (direct current) converter 1213 and a bridge rectifier 1214. Therein, the AC power source 1211 provides an AC power to the EMI noise filter and surge absorber 1212; the EMI noise filter and surge absorber 1212 keeps the power source stable and avoids interferences by noises. Then the power source is transferred to the power stage module 122 by the bridge rectifier 1214. In the other hand, the AC power source 1211 provides AC power to the AC/DC converter 1213 for transforming the AC power into a DC power; and then the transformed DC power is transferred to the power stage module 122 and the feed-back control module 123.

The power stage module 122 comprises a half-bridge series resonant converter 1221 and a driving circuit 1222. The half-bridge series resonant converter 1221 receives the power source transferred from the bridge rectifier 1214 of the input stage module 121; receives signals transferred by the driving circuit 1222; and transfers energy to the first energy coil 111 of the non-contact transformer 11. The half-bridge series resonant converter 1221 operates a frequency on a resonant frequency for no voltage alternating on power switch to reduce power loss.

The feed-back control module 123 comprises a gap detection circuit 1231, a load detection circuit 1232 and a micro control unit 1233. The gap detection circuit 1231 and the load detection circuit 1232 of the feed-back control module 1233 receive signals transferred from the second signal coil 112 and the third signal coil 113 respectively. Then the signals are transferred to the micro control unit 1233. The micro control unit 1233 obtains its power from the input stage module 121; and processes signals transferred from the gap detection circuit 1231 and the load detection circuit to be outputted to the driving circuit 1222.

And then, the signals are transferred from the primary device 12 to the secondary device 13 to be outputted, where the signals are transferred to the secondary device 13 in a resonant way between the first core 111 and the second core 112 in the non-contact transformer 11. The secondary device 13 comprises an output stage module 131; the output stage module 131 comprises a center-tapped rectifier 1311, a capacitor filter 1312 and a load unit 1313; the output stage module 131 receives power transferred from the non-contact transformer 11 and outputs a stable voltage through the center-tapped rectifier 1311 and the capacitor filter 1312.

Hence, the present invention has the following advantages:

1. The present invention uses a non-contact transformer having an EE core so that a non-contact power system transfers power and signal at the same time.

2. A secondary device requires no sensor or feed-back controller at output.

3. A first core and a second core in the non-contact transformer senses changes in load and gap size according to a size and a distribution of its magnetic field 4. The first core and the second core in the non-contact transformer detect the size of the gap with a sum of voltage of signal coils and detect the changes in load with a subtraction of voltage of energy coils.

5. A half-bridge series resonant converter of a power stage module enhances power transference in a resonant way.

6. The present invention automatically figures out a best power with a stable voltage according to the changes between the gap and the load.

To sum up, the present invention is a non-contact power system with load and gap detection, where electromagnetic coupling is used to obtain changes in gap size and load output; power and signals are transferred at the same time through a core in a non-contact transformer; and frequency can be automatically adjusted to obtain a stable voltage.

The preferred embodiment therein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A non-contact power system with load and gap detection, comprising:

a non-contact transformer, said non-contact transformer comprising a first core and a second core, said first core comprising one energy coil and two signal coil, said second core comprising one energy coil and two signal coil;

a primary device, said primary device being connected with said first core, said primary device comprising an input stage module, a power stage module and a feed-back control module; and a secondary device, said secondary device being connected with said second core, said secondary device comprising an output stage module, wherein said two signal coils of said second core have a reverse winding direction to said energy coil of said second core.

2. The system according to claim 1, wherein said first core further comprises one energy coil and two signal coil.

3. The system according to claim 1, wherein said second core further comprises one energy coil and two signal coil.

4. The system according to claim 1, wherein said energy coil of said first core has the same winding direction as said energy coil of said second core.

5. The system according to claim 1, wherein said two signal coils of said first core have the same winding direction as said energy coil of said first core.

6. The system according to claim 1, wherein one of said signal coils at an end of said first core has the same winding direction as said energy coil of said first core; and wherein the other one of said signal coils at the other end of said first core has a reverse winding direction to said energy coil of said first core.

7. The system according to claim 1, wherein said input stage module comprises an alternating current (AC) power source, an electro-magnetic interference (EMI) noise filter and surge absorber, an AC/DC(direct current) converter and a bridge rectifier.

8. The system according to claim 1, wherein said power stage module comprises a half-bridge series resonant converter and a driving circuit.

9. The system according to claim 1, wherein said feed-back control module comprises a gap detection circuit, a load detection circuit and a micro control unit.

10. The system according to claim 1, wherein said output stage module, comprises a center-tapped rectifier, a capacitor filter and a load unit.

11. A non-contact power system with load and gap detection, comprising:

a non-contact transformer, said non-contact transformer comprising a first core and a second core, said first core comprising one energy coil and two signal coil, said second core comprising one energy coil and two signal coil;

a primary device, said primary device being connected with said first core, said primary device comprising an input stage module, a power stage module and a feed-back control module; and a secondary device, said secondary device being connected with said second core, said secondary device comprising an output stage module, wherein one of said signal coils at an end of said first core has the same winding direction as said energy coil of said first core, and wherein the other one of said signal coils at the other end of said first core has a reverse winding direction to said energy coil of said first core.

12. The system according to claim 11, wherein said first core further comprises one energy coil and two signal coil.

13. The system according to claim 11, wherein said second core further comprises one energy coil and two signal coil.

14. The system according to claim 11, wherein said energy coil of said first core has the same winding direction as said energy coil of said second core.

15. The system according to claim 11, wherein said two signal coils of said second core have a reverse winding direction to said energy coil of said second core.

16. The system according to claim 11, wherein said two signal coils of said first core have the same winding direction as said energy coil of said first core.

17. The system according to claim 11, wherein said input stage module comprises an alternating current (AC) power source, an electro-magnetic interference (EMI) noise filter and surge absorber, an AC/DC(direct current) converter and a bridge rectifier.

18. The system according to claim 11, wherein said power stage module comprises a half-bridge series resonant converter and a driving circuit.

19. The system according to claim 11, wherein said feed-back control module comprises a gap detection circuit, a load detection circuit and a micro control unit.

20. The system according to claim 11, wherein said output stage module, comprises a center-tapped rectifier, a capacitor filter and a load unit.

* * * * *